US010464771B2

(12) United States Patent
Liao et al.

(10) Patent No.: US 10,464,771 B2
(45) Date of Patent: Nov. 5, 2019

(54) SCANNING DEVICE

(71) Applicant: FOXLINK IMAGE TECHNOLOGY CO., LTD., New Taipei (TW)

(72) Inventors: Wen Ching Liao, New Taipei (TW); Chi Wen Chen, New Taipei (TW)

(73) Assignee: FOXLINK IMAGE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/183,921

(22) Filed: Nov. 8, 2018

(65) Prior Publication Data

US 2019/0185284 A1 Jun. 20, 2019

(30) Foreign Application Priority Data

Dec. 14, 2017 (TW) ..... 106144026 A

(51) Int. Cl.

| | |
|---|---|
| ***B65H 29/60*** | (2006.01) |
| ***B65H 3/06*** | (2006.01) |
| ***B65H 5/06*** | (2006.01) |
| ***B65H 43/00*** | (2006.01) |

(52) U.S. Cl.

CPC ..... *B65H 29/60* (2013.01); *B65H 3/06* (2013.01); *B65H 5/06* (2013.01); *B65H 43/00* (2013.01)

(58) Field of Classification Search

CPC .. B65H 3/0684; B65H 3/5246; B65H 3/5261; B65H 5/06; B65H 5/062; B65H 7/12; B65H 7/125; B65H 29/60; B65H 29/125; B65H 43/00; B65H 43/04; B65H 2801/39; B65H 2553/30; B65H 2511/524

See application file for complete search history.

(56) References Cited

U.S. PATENT DOCUMENTS

| | | | | |
|---|---|---|---|---|
| 2004/0150155 | A1* | 8/2004 | Okitsu | B65H 7/125 271/262 |
| 2004/0201159 | A1* | 10/2004 | Sheng | B65H 5/06 271/3.14 |
| 2017/0275112 | A1* | 9/2017 | Saito | B65H 7/125 |
| 2018/0194580 | A1* | 7/2018 | Arima | B65H 7/125 |
| 2018/0257887 | A1* | 9/2018 | Reinke | B65H 9/06 |
| 2018/0302523 | A1* | 10/2018 | Maruyama | B65H 3/5284 |

* cited by examiner

*Primary Examiner* — David H Bollinger
(74) *Attorney, Agent, or Firm* — WPAT, PC

(57) ABSTRACT

A scanning device includes at least one motor, an input tray, a pickup roller, a separation roller module, an ultrasonic sensor, a scanning module, a path switcher and a controller. The pickup roller is connected with the at least one motor. The separation roller module is connected with the at least one motor. The ultrasonic sensor includes an ultrasonic emitter and an ultrasonic receiver. The ultrasonic sensor is used for sensing that a single paper or multiple papers are fed in. The scanning module is used for scanning a plurality of papers. The path switcher is connected with the at least one motor. The at least one motor is capable of driving the path switcher to be switched to a first position and a second position. The controller is connected with the at least one motor and the ultrasonic sensor.

8 Claims, 4 Drawing Sheets

SCANNING DEVICE

CROSS-REFERENCE TO RELATED APPLICATION

The present application is based on, and claims priority form, Taiwan Patent Application No. 106144026, filed Dec. 14, 2017, the disclosure of which is hereby incorporated by reference herein in its entirety.

BACKGROUND OF THE INVENTION

1. Field of the Invention

The present invention generally relates to a scanning device, and more particularly to a scanning device with double paper-out channels.

2. The Related Art

Generally, a conventional scanning device having an automatic paper-feeding function, includes a sensor for detecting whether a condition of multiple pieces of paper being fed in is occurred or not in a scanning process, so that documents are prevented from being missed being scanned.

When the conventional scanning device detects the condition of the multiple pieces of the paper being fed in, two choices which are a first choice and a second choice are set. The first choice is described as follows. When the conventional scanning device detects the condition of the multiple pieces of the paper being fed in, the conventional scanning device stops scanning, after an operator takes out the multiple pieces of the paper, and then the conventional scanning device continues scanning. The second choice is described as follows. When the conventional scanning device detects the condition of the multiple pieces of the paper being fed in, the conventional scanning device will continue scanning, after the conventional scanning device stops scanning, the operator takes out the documents which are missed being scanned from the multiple pieces of the paper, and the documents which are missed being scanned are remedied to be scanned for allowing all the documents to be scanned. However, a drawback of the first choice is that the conventional scanning device will stop scanning in a scanning process, the operator need take out the multiple pieces of the paper which are fed in, and then the conventional scanning device will continue proceeding scanning again, and a drawback of the second choice is that the operator must find the documents which are missed being scanned from the multiple pieces of the paper. Thus the above-mentioned two choices will both cause inconveniences in use.

SUMMARY OF THE INVENTION

An object of the present invention is to provide a scanning device. An inside of the scanning device has a paper feeding channel communicated with an outside, a scanning channel located in front of the paper feeding channel, and two paper-out channels located in front of the scanning channel. The scanning channel is connected and communicated with the paper feeding channel. The two paper-out channels are respectively connected with the scanning channel. The scanning device includes at least one motor, an input tray, a pickup roller, a separation roller module, an ultrasonic sensor, a scanning module, a path switcher and a controller. The input tray is disposed behind the paper feeding channel and is used for positioning a plurality of papers which are to be scanned. The pickup roller is connected with the at least one motor, and the pickup roller is capable of being disposed above the input tray and moving up and down. The at least one motor drives the pickup roller to rotate to pick up each of the plurality of the papers which are to be scanned and each of the plurality of the papers which are to be scanned is fed forward to the paper feeding channel. The separation roller module is assembled in the paper feeding channel and adjacent to one end of the input tray. The separation roller module is connected with the at least one motor. The at least one motor drives the separation roller module to separate the plurality of the papers which are fed into the paper feeding channel. The ultrasonic sensor includes an ultrasonic emitter and an ultrasonic receiver. The ultrasonic emitter and the ultrasonic receiver are disposed adjacent to an upper side and a lower side of the paper feeding channel, respectively, and the ultrasonic emitter and the ultrasonic receiver are disposed in front of the separation roller module. The ultrasonic sensor is used for sensing that a single paper which is separated by the separation roller module or multiple papers which are separated by the separation roller module are fed in. The scanning module is assembled in the scanning channel and is used for scanning the plurality of the separated papers. The path switcher is connected with the at least one motor and disposed to a position where the two paper-out channels are connected with the scanning channel. The at least one motor is capable of driving the path switcher to be switched to a first position and a second position. When the path switcher is switched to the first position, one of the two paper-out channels is closed by the path switcher, and the one of the two paper-out channels is isolated from the scanning channel by the path switcher, the other paper-out channel is communicated with the scanning channel, when the path switcher is switched to the second position, the one of the two paper-out channels which is originally closed is opened and communicated with the scanning channel, and the other paper-out channel which is originally communicated with the scanning channel is closed. The controller is connected with the at least one motor and the ultrasonic sensor. The controller controls the at least one motor to drive the path switcher to be switched to the first position or the second position by virtue of detecting that a signal transmitted from the ultrasonic sensor is a signal of the single paper being fed by the separation roller module or a signal of the multiple papers being fed by the separation roller module, so that the fed single paper and the fed multiple papers are selectively fed out from the two paper-out channels, respectively in a process of scanning the plurality of the papers.

As described above, the controller of the scanning device controls the at least one motor to drive the path switcher to be switched to the first position or the second position by virtue of detecting the signal transmitted from the ultrasonic sensor is the signal of feeding in the single paper separated by the separation roller module or the signal of feeding in the multiple papers separated by the separation roller module, so that the fed single paper and the fed multiple papers are selectively fed out from the two paper-out channels, respectively in the process of scanning the plurality of the papers, after completing scanning the plurality of the papers, the multiple papers just need proceeding being remedied to be scanned, so that all the plurality of the papers are completed being scanned. Thus, when the multiple papers are fed into the scanning device in the process of scanning the plurality of the papers, the scanning device will still bring an convenience in use for satisfying needs of users.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
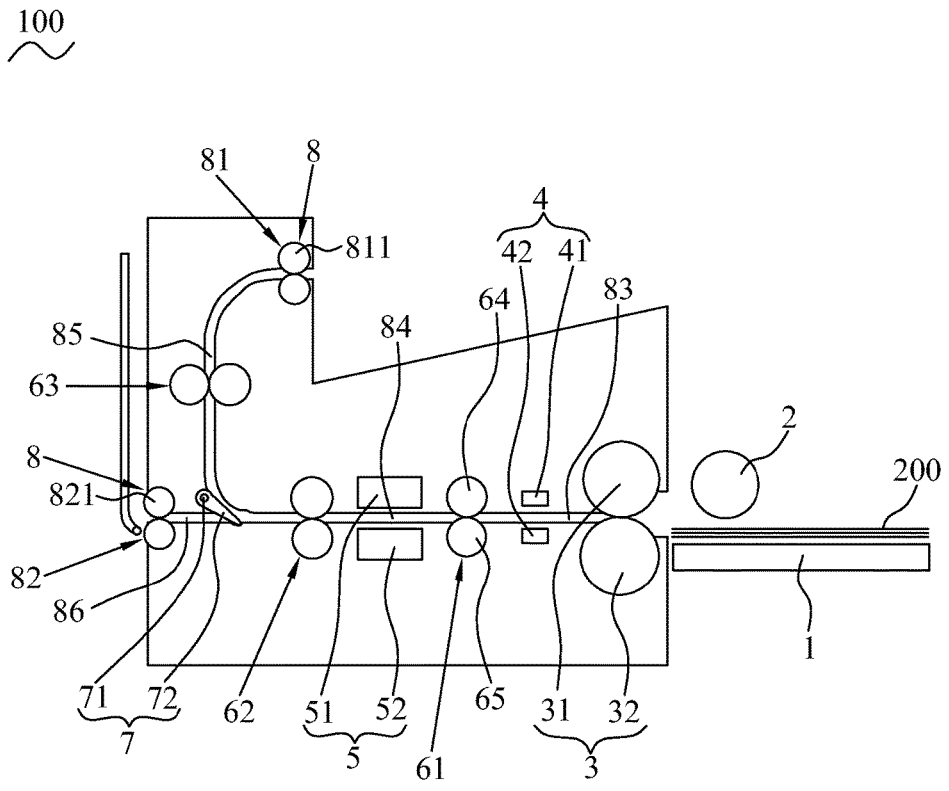
FIG. 1 is a schematic diagram of a scanning device in accordance with a preferred embodiment of the present invention.
Figure 2:
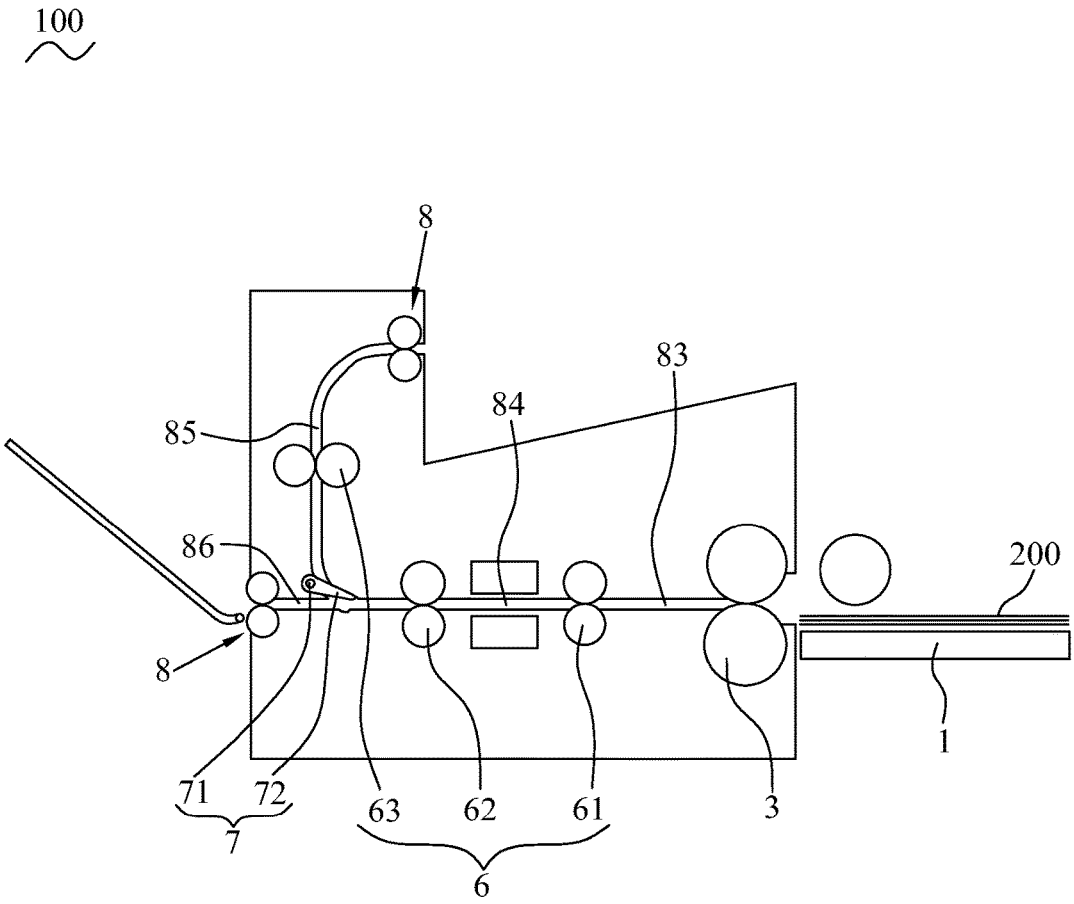
FIG. 2 is another schematic diagram of the scanning device in accordance with the preferred embodiment of the present invention.
Figure 4:
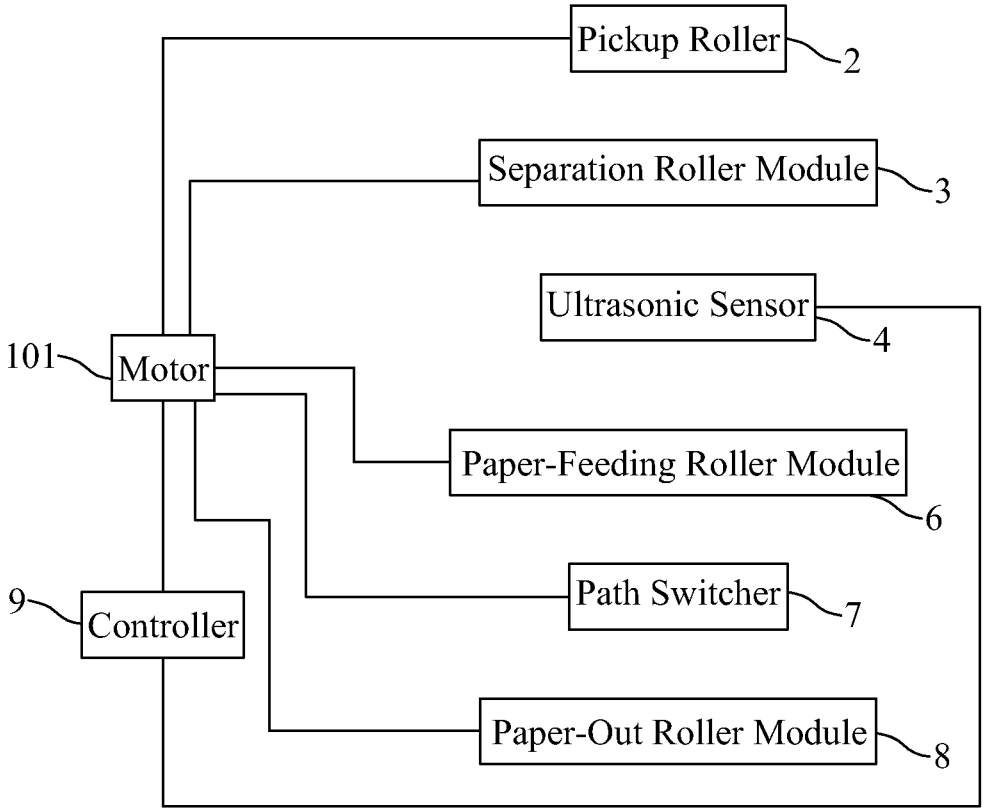
FIG. 4 is a partial block diagram of the scanning device in accordance with the preferred embodiment of the present invention.

With reference to FIG. 1, FIG. 2 and FIG. 4, a scanning device 100 in accordance with a preferred embodiment of the present invention is shown. The scanning device 100 is adapted for scanning a plurality of papers 200. The scanning device 100 includes at least one motor 101, an input tray 1, a pickup roller 2, a separation roller module 3, an ultrasonic sensor 4, a scanning module 5, a plurality of paper-feeding roller modules 6, a path switcher 7, two paper-out roller modules 8 and a controller 9.

With reference to FIG. 1 and FIG. 4, an inside of the scanning device 100 has a paper feeding channel 83 communicated with an outside. A feeding direction of each of the plurality of the papers 200 is defined as a forward direction. A direction opposite to the feeding direction of each of the plurality of the papers 200 is defined as a reverse direction. The inside of the scanning device 100 has a scanning channel 84 located in front of the paper feeding channel 83, and two paper-out channels located in front of the scanning channel 84. The scanning channel 84 is connected and communicated with the paper feeding channel 83. The two paper-out channels are respectively connected with the scanning channel 84. Specifically, one of the two paper-out channels is defined as a first paper-out channel 85, and the other paper-out channel is defined as a second paper-out channel 86. The first paper-out channel 85 is located at an upstream of the scanning device 100.

The input tray 1 is disposed behind the paper feeding channel 83, and is used for positioning the plurality of the papers 200 which are to be scanned. The plurality of the papers 200 are stacked up and down on the input tray 1. The pickup roller 2 is connected with the at least one motor 101, and the pickup roller 2 is capable of being disposed above the input tray 1 and moving up and down. The at least one motor 101 drives the pickup roller 2 to rotate to pick up each of the plurality of the papers 200 which are to be scanned and each of the plurality of the papers 200 which are to be scanned is fed forward to the paper feeding channel 83.

The separation roller module 3 is assembled in the paper feeding channel 83 and adjacent to one end of the input tray 1. The separation roller module 3 is connected with the at least one motor 101, and the separation roller module 3 includes an upper separation roller 31 and a lower separation roller 32. The upper separation roller 31 and the lower separation roller 32 are disposed to an upper side and a lower side of the paper feeding channel 83, respectively. The at least one motor 101 drives the separation roller module 3 to separate the plurality of the papers 200 which are fed into the paper feeding channel 83.

The ultrasonic sensor 4 includes an ultrasonic emitter 41 and an ultrasonic receiver 42. The ultrasonic emitter 41 and the ultrasonic receiver 42 are disposed adjacent to and spaced from the upper side and the lower side of the paper feeding channel 83, respectively, and the ultrasonic emitter 41 and the ultrasonic receiver 42 are disposed in front of the separation roller module 3. The ultrasonic sensor 4 is used for sensing that a single paper 200 which is separated by the separation roller module 3 or multiple papers 200 which are separated by the separation roller module 3 are fed in. The scanning module 5 is assembled in the scanning channel 84 and is used for scanning the plurality of the separated papers 200. The scanning module 5 includes an upper scanning module 51 and a lower scanning module 52. The scanning module 5 is located in front of the ultrasonic sensor 4. The upper scanning module 51 and the lower scanning module 52 are disposed adjacent to and spaced from an upper side and a lower side of the scanning channel 84, respectively.

Figure 3:
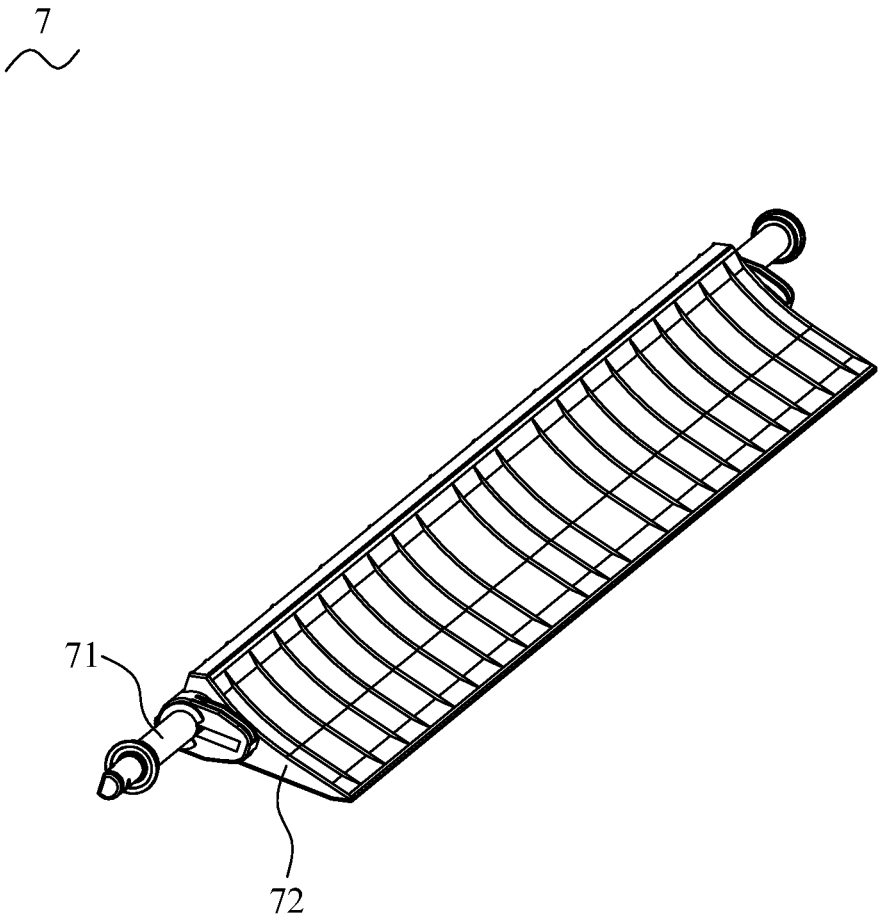
FIG. 3 is a perspective view of a path switcher of the scanning device in accordance with the preferred embodiment of the present invention.

Referring to FIG. 1, FIG. 3 and FIG. 4, the path switcher 7 is connected with the at least one motor 101 and is disposed to a position where the two paper-out channels are connected with the scanning channel 84. The at least one motor 101 is capable of driving the path switcher 7 to be switched to a first position and a second position. When the path switcher 7 is switched to the first position, one of the two paper-out channels is closed by the path switcher 7, and the one of the two paper-out channels is isolated from the scanning channel 84 by the path switcher 7, whereas the other paper-out channel is communicated with the scanning channel 84. When the path switcher 7 is switched to the second position, the one of the two paper-out channels which is originally closed is opened and communicated with the scanning channel 84, and the other paper-out channel which is originally communicated with the scanning channel 84 is closed.

In the preferred embodiment, the path switcher 7 includes a rotation shaft 71 connected with the at least one motor 101, and a sealing piece 72 fastened to the rotation shaft 71. The at least one motor 101 drives the rotation shaft 71 to rotate to make the sealing piece 72 alternately switched to the first position and the second position. When the sealing piece 72 is switched to the first position, the sealing piece 72 seals the second paper-out channel 86 to make the second paper-out channel 86 be without being communicated with the scanning channel 84, and the first paper-out channel 85 is communicated with the scanning channel 84. When the sealing piece 72 is switched to the second position, the sealing piece 72 seals the first paper-out channel 85 to make the first paper-out channel 85 be without being communicated with the scanning channel 84, and the second paper-out channel 86 is communicated with the scanning channel 84.

Referring to FIG. 1 to FIG. 4, the two paper-out roller modules 8 are disposed to tail ends of the two paper-out channels, respectively. The two paper-out roller modules 8 are disposed to tail ends of the first paper-out channel 85 and the second paper-out channel 86, respectively. The two paper-out roller modules 8 are connected with the at least one motor 101. The at least one motor 101 drives the two paper-out roller modules 8 to feed out the plurality of the papers 200 in the two paper-out channels which are the first paper-out channel 85 and the second paper-out channel 86.

In the preferred embodiment, one of the two paper-out roller modules 8 is defined as a first paper-out roller module 81, and the other paper-out roller module 8 is defined as a second paper-out roller module 82. The first paper-out roller module 81 is connected with the at least one motor 101. The first paper-out roller module 81 includes two first paper-out rollers 811. The two first paper-out rollers 811 are disposed to two sides of a tail end of the first paper-out channel 85, respectively and disposed opposite to each other. The second paper-out roller module 82 is connected with the at least one motor 101. The second paper-out roller module 82 includes two second paper-out rollers 821. The two second paper-out rollers 821 are disposed to two sides of a tail end of the second paper-out channel 86, respectively and disposed opposite to each other.

Referring to FIG. 1, FIG. 2 and FIG. 4, the plurality of the paper-feeding roller modules 6 are connected with and driven by the at least one motor 101 for transmitting the plurality of the fed papers 200. The plurality of the paper-feeding roller modules 6 are disposed in the paper feeding channel 83, the scanning channel 84 and the one of the two paper-out channels, respectively. The plurality of the paper-feeding roller modules 6 are disposed in the paper feeding channel 83, the scanning channel 84 and the first paper-out channel 85, respectively. Each of the plurality of the paper-feeding roller modules 6 includes an upper feeding roller 64 and a lower feeding roller 65. The upper feeding rollers 64 and the lower feeding rollers 65 of the plurality of the paper-feeding roller modules 6 are disposed in two sides of the paper feeding channel 83, two sides of the scanning channel 84 and two sides of the first paper-out channel 85, respectively, and the upper feeding roller 64 and the lower feeding roller 65 of each of the plurality of the paper-feeding roller modules 6 are opposite to each other. The upper feeding rollers 64 and the lower feeding rollers 65 of the plurality of the paper-feeding roller modules 6 are disposed among the separation roller module 3, the first paper-out roller module 81 and the second paper-out roller module 82. In the preferred embodiment, the plurality of the paper-feeding roller modules 6 include three paper-feeding roller modules 6 which are a first paper feeding roller module 61, a second paper feeding roller module 62 and a third paper feeding roller module 63. The first paper feeding roller module 61 is disposed in the paper feeding channel 83 and is located in front of the ultrasonic sensor 4. The second paper feeding roller module 62 is disposed in the scanning channel 84 and is located in front of the scanning module 5. The third paper feeding roller module 63 is disposed in the first paper-out channel 85. The controller 9 is connected with the at least one motor 101 and the ultrasonic sensor 4. The controller 9 controls the at least one motor 101 to drive the path switcher 7 to be switched to the first position or the second position by virtue of detecting that a signal transmitted from the ultrasonic sensor 4 is a signal of the single paper 200 being fed by the separation roller module 3 or a signal of the multiple papers 200 being fed by the separation roller module 3, so that the fed single paper 200 and the fed multiple papers 200 are selectively fed out from the two paper-out channels, respectively in a process of scanning the plurality of the papers 200.

Referring to FIG. 1 to FIG. 4, a working principle of the scanning device 100 is described as follows. In an initial state, the sealing piece 72 is switched to the first position, after a user gives a scanning instruction, the pickup roller 2 moves downward until the pickup roller 2 abuts against a top surface of an uppermost paper 200 which is to be scanned, the controller 9 controls the at least one motor 101 to drive the pickup roller 2 to rotate to pick up the uppermost paper 200 which is to be scanned and the uppermost paper 200 which is to be scanned is fed forward to the paper feeding channel 83. The at least one motor 101 drives the upper separation roller 31 and the lower separation roller 32 of the separation roller module 3 to rotate, the upper separation roller 31 cooperates with the lower separation roller 32 to separate the plurality of the papers 200 which are fed into the paper feeding channel 83, and then the scanning device 100 continues feeding the separated papers 200 forward. The ultrasonic sensor 4 senses that the single paper 200 which is separated by the separation roller module 3 or the multiple papers 200 which are separated by the separation roller module 3 are fed in. Specifically, the ultrasonic emitter 41 emits ultrasonic wave signals penetrating through the paper 200 which is separated by the separation roller module 3, the ultrasonic receiver 42 receives the ultrasonic wave signals emitted by the ultrasonic emitter 41, the ultrasonic receiver 42 is able to detect that the single paper 200 separated by the separation roller module 3 or the multiple papers 200 separated by the separation roller module 3 are fed in by virtue of the received ultrasonic wave signals.

When the single paper 200 separated by the separation roller module 3 is detected to be fed in, the first paper feeding roller module 61 continues feeding the paper 200 through the ultrasonic sensor 4 to the scanning channel 84. The upper scanning module 51 cooperates with the lower scanning module 52 to scan the separated paper 200, and then the scanned paper 200 is fed into the first paper-out channel 85 by way of the second paper feeding roller module 62, the third paper feeding roller module 63 continues feeding forward the paper 200 which is fed into the first paper-out channel 85, and then the paper 200 is fed out by the first paper-out roller module 81. When the ultrasonic sensor 4 detects that the multiple papers 200 are fed in, the signal of feeding in the multiple papers 200 is transmitted to the controller 9, the controller 9 controls the at least one motor 101 to drive the sealing piece 72 of the path switcher 7 to be switched to the second position, the first paper feeding roller module 61 and the second paper feeding roller module 62 transmit the multiple papers 200 which are fed in to the second paper-out channel 86, and the multiple papers 200 are fed out by the second paper-out roller module 82, at the moment, the scanning module 5 is stopped, namely the multiple papers 200 are without proceeding being scanned. After completing scanning the plurality of the papers 200, the multiple papers 200 fed out from the second paper-out channel 86 just need proceeding being remedied to be scanned, so that all the plurality of the papers 200 are completed being scanned.

As described above, the controller 9 of the scanning device 100 controls the at least one motor 101 to drive the path switcher 7 to be switched to the first position or the second position by virtue of detecting that the signal transmitted from the ultrasonic sensor 4 is the signal of the single paper 200 being fed by the separation roller module 3 or the signal of the multiple papers 200 being fed by the separation roller module 3, so that the fed single paper 200 and the fed multiple papers 200 are selectively fed out from the two paper-out channels, respectively in the process of scanning the plurality of the papers 200, after completing scanning the plurality of the papers 200, the multiple papers 200 just need proceeding being remedied to be scanned, so that all the plurality of the papers 200 are completed being scanned. Thus, when the multiple papers 200 are fed into the scanning device 100 in the process of scanning the plurality of the papers 200, the scanning device 100 will still bring an convenience in use for satisfying needs of users.

What is claimed is:

1. A scanning device, an inside of the scanning device having a paper feeding channel communicated with an outside, a scanning channel located in front of the paper feeding channel, and two paper-out channels located in front of the scanning channel, the scanning channel being connected and communicated with the paper feeding channel, the two paper-out channels being respectively connected with the scanning channel, the scanning device comprising:

at least one motor;

an input tray disposed behind the paper feeding channel and used for positioning a plurality of papers which are to be scanned;

a pickup roller connected with the at least one motor, and the pickup roller being capable of being disposed above the input tray and moving up and down, the at least one motor driving the pickup roller to rotate to pick up each of the plurality of the papers which are to be scanned and each of the plurality of the papers which are to be scanned being fed forward to the paper feeding channel;

a separation roller module assembled in the paper feeding channel and adjacent to one end of the input tray, the separation roller module being connected with the at least one motor, the at least one motor driving the separation roller module to separate the plurality of the papers which are fed into the paper feeding channel;

an ultrasonic sensor including an ultrasonic emitter and an ultrasonic receiver, the ultrasonic emitter and the ultrasonic receiver being disposed adjacent to an upper side and a lower side of the paper feeding channel, respectively, and the ultrasonic emitter and the ultrasonic receiver being disposed in front of the separation roller module, the ultrasonic sensor being used for sensing that a single paper which is separated by the separation roller module or multiple papers which are separated by the separation roller module being fed in;

a scanning module assembled in the scanning channel and used for scanning the plurality of the separated papers;

a path switcher connected with the at least one motor and disposed to a position where the two paper-out channels are connected with the scanning channel, the at least one motor being capable of driving the path switcher to be switched to a first position and a second position, when the path switcher is switched to the first position, one of the two paper-out channels being closed by the path switcher, and the one of the two paper-out channels being isolated from the scanning channel by the path switcher, the other paper-out channel being communicated with the scanning channel, when the path switcher is switched to the second position, the one of the two paper-out channels which is originally closed being opened and communicated with the scanning channel, and the other paper-out channel which is originally communicated with the scanning channel being closed; and a controller connected with the at least one motor and the ultrasonic sensor, the controller controlling the at least one motor to drive the path switcher to be switched to the first position or the second position by virtue of detecting that a signal transmitted from the ultrasonic sensor is a signal of the single paper being fed by the separation roller module or a signal of the multiple papers being fed by the separation roller module, so that the fed single paper and the fed multiple papers are selectively fed out from the two paper-out channels, respectively in a process of scanning the plurality of the papers.

2. The scanning device as claimed in claim 1, wherein the scanning module includes an upper scanning module and a lower scanning module, the upper scanning module and the lower scanning module are disposed adjacent to an upper side and a lower side of the scanning channel, respectively.

3. The scanning device as claimed in claim 2, wherein the upper scanning module and the lower scanning module are spaced from the upper side and the lower side of the scanning channel, respectively.

4. The scanning device as claimed in claim 1, wherein the path switcher includes a rotation shaft connected with the at least one motor, and a sealing piece fastened to the rotation shaft, the at least one motor drives the rotation shaft to rotate to make the sealing piece alternately switched to the first position and the second position.

5. The scanning device as claimed in claim 1, further comprising two paper-out roller modules disposed to tail ends of the two paper-out channels, respectively, the two paper-out roller modules being connected with the at least one motor, the at least one motor driving the two paper-out roller modules to feed out the plurality of the papers in the two paper-out channels.

6. The scanning device as claimed in claim 1, further comprising a plurality of paper-feeding roller modules connected with and driven by the at least one motor for transmitting the plurality of the fed papers, the plurality of the paper-feeding roller modules being disposed in the paper feeding channel, the scanning channel and the one of the two paper-out channels, respectively.

7. The scanning device as claimed in claim 1, wherein the scanning module is located in front of the ultrasonic sensor.

8. The scanning device as claimed in claim 1, wherein the ultrasonic emitter and the ultrasonic receiver are spaced from the upper side and the lower side of the paper feeding channel, respectively.

* * * * *